US012507796B2

(12) United States Patent
Chen

(10) Patent No.: US 12,507,796 B2
(45) Date of Patent: Dec. 30, 2025

(54) EASY-TO-TRANSPORT ASSEMBLED TABLE

(71) Applicant: SOPHIA & WILLIAM BRANDS CO. LTD, Nanjing (CN)

(72) Inventor: Meidi Chen, Nanjing (CN)

(73) Assignee: SOPHIA & WILLIAM BRANDS CO. LTD, Nanjing (CN)

( * ) Notice: Subject to any disclaimer, the term of this patent is extended or adjusted under 35 U.S.C. 154(b) by 196 days.

(21) Appl. No.: 18/504,731

(22) Filed: Nov. 8, 2023

(65) Prior Publication Data

US 2025/0143450 A1 May 8, 2025

(51) Int. Cl.
*A47B 13/00* (2006.01)
*A47B 37/04* (2006.01)

(52) U.S. Cl.
CPC ..... *A47B 13/003* (2013.01); *A47B 37/04* (2013.01)

(58) Field of Classification Search
CPC ..... A47B 3/06; A47B 13/02; A47B 37/04; A47B 13/003; A47B 13/088; A47B 13/021
USPC ..... 108/65, 180, 181, 185, 186, 190, 157.1, 108/158, 158.11, 153.1; 248/188.91, 248/188.8, 188, 188.1
See application file for complete search history.

(56) References Cited

U.S. PATENT DOCUMENTS

D334,313 S * 3/1993 Grosfillex ..... D6/692
7,296,522 B1 * 11/2007 Mahmalji ..... A47B 37/04 108/50.13
7,588,295 B2 * 9/2009 Goodman ..... A47C 9/00 248/188.91
8,161,891 B2 * 4/2012 Palese ..... A47B 1/08 108/50.01
8,418,633 B1 * 4/2013 Lee ..... A47B 13/003 108/157.15
8,522,696 B1 * 9/2013 Lee ..... A47B 13/08 108/27
8,925,468 B2 * 1/2015 Polidoros ..... A47B 13/08 108/27
D1,019,223 S * 3/2024 Chen ..... D6/691.1
D1,022,556 S * 4/2024 Chen ..... D6/702
D1,034,017 S * 7/2024 Chen ..... D6/691.1
(Continued)

FOREIGN PATENT DOCUMENTS

CN 103330421 A 10/2013
CN 210276324 U 4/2020
(Continued)

*Primary Examiner* — Janet M Wilkens
(74) *Attorney, Agent, or Firm* — Nitin Kaushik

(57) ABSTRACT

An easy-to-transport assembled table includes table legs disposed at each of four corners of a lower end surface of a table top and fixed by bolts, where the table top is assembled by at two or more table plates. Each table leg comprises one main supporting leg and two symmetrically configured supporting arms, the main supporting leg is vertically arranged with a first end in contact with the table top and a second end in contact with the ground when the table is in use, the two supporting arms extend out from the main supporting leg toward a plane where the square reinforcement frame is located to converge with each other, thereby forming a triangular structure with the main supporting leg, a joint of the two supporting arms is provided with a connector, and the connector is configured to connect the table leg with the square reinforcement frame.

5 Claims, 12 Drawing Sheets

(56) References Cited

U.S. PATENT DOCUMENTS

| | | | | | |
|---|---|---|---|---|---|
| D1,047,547 | S * | 10/2024 | Chen | D6/707.19 | |
| 2004/0226487 | A1* | 11/2004 | Yang | A47B 37/04 | 108/50.12 |
| 2012/0304902 | A1* | 12/2012 | Ruzicka | A47B 3/08 | 29/700 |
| 2021/0219711 | A1* | 7/2021 | Lai | A47B 3/06 | |
| 2024/0000223 | A1* | 1/2024 | Yang | A47B 13/06 | |
| 2025/0176705 | A1* | 6/2025 | Chen | A47B 37/04 | |

FOREIGN PATENT DOCUMENTS

| | | | | | |
|---|---|---|---|---|---|
| CN | 211820274 | U | 10/2020 | | |
| CN | 113508986 | A * | 10/2021 | A47B 91/026 | |
| CN | 115701920 | A * | 2/2023 | F24F 8/108 | |
| CN | 119453655 | A * | 2/2025 | A47B 13/003 | |
| KR | 200437233 | Y1 * | 11/2007 | A47B 13/021 | |
| KR | 20200000848 | U * | 4/2020 | A47B 13/021 | |

* cited by examiner

EASY-TO-TRANSPORT ASSEMBLED TABLE

TECHNICAL FIELD

The present invention relates to the technical field of tableware, in particular to an easy-to-transport assembled table.

BACKGROUND

At present, existing tables on the market are all of an integral structure or a structure with detachable table plates and table legs. However, due to the large size of the entire table plate, the process of transportation and carrying is time-consuming and laborious, causing a high transportation cost of products; for the table plate having the structure with detachable table plates and table legs, users need to install the table plate by themselves. Further, the large table plate is heavy and easy to collide during installation, making the installation process time-consuming and laborious.

For example, Chinese invention patent CN215583395U discloses an outdoor table capable of being quickly assembled, including a support plate mechanism, where a folding mechanism is movably connected to a bottom of the support plate mechanism, and an adjusting mechanism is sleeved on an outer surface of the folding mechanism. During use, the table can be quickly assembled and supported by the folding mechanism, and meanwhile, the height of the table can be adjusted according to needs by the adjusting mechanism. However, the table has an integral table top which is large in area and not easy to transport.

Therefore, the present applicant provides an easy-to-transport assembled table, for solving the problems raised in the above background.

SUMMARY

The present invention aims to provide an easy-to-transport assembled table, which solves the technical problem that an existing table is relatively large as a whole, the integral piece of a table top is relatively large, the transportation cost is high, and the table is inconvenient to transport.

In order to solve the above technical problem, the present invention provides an easy-to-transport assembled table, including table legs disposed at each of four corners of a lower end surface of a table top and fixed by bolts, where the table top is assembled by two or more table plates.

A further improvement of a technical solution of the present invention is that: table legs are disposed at each of four corners of a lower end surface of a table top, where the table top consists of four table plates of the same size assembled together.

A further improvement of the technical solution of the present invention is that: the table plate includes a frame and the table plate welded on an inner side of the frame, a top surface of the frame and a top surface of the table plate are located in the same plane, a bottom surface of the frame is lower than a bottom surface of the table plate, a plurality of bolt holes are disposed in an assembling side edge of the frame, and the table plates are assembled to form the table top through the bolt holes and bolts.

A further improvement of the technical solution of the present invention is that: a reinforcement frame is disposed at a middle part of the lower end surface of the table top, where the reinforcement frame is fixed through a reinforcement frame fixing hole, enhancing stability of the assembled table top.

A further improvement of the technical solution of the present invention is that: a connection member is welded and disposed on each of four corners of a bottom surface of the table top, where the connection members are provided with a table plate fixing hole, respectively, and top parts of the table legs are fixed to the bottom surfaces of the connection members through the bolts and the table plate fixing holes.

A further improvement of the technical solution of the present invention is that: a length of each table leg is less than a width of an inner side of the frame, facilitating storage of the table legs in the inner side of the frame.

A further improvement of the technical solution of the present invention is that: a through-hole is disposed in a middle part of the table top for installing and placing an outdoor sunshade.

A further improvement of the technical solution of the present invention is that: a square reinforcement frame is disposed below the table top, where the square reinforcement frame is fixed to a middle part of each table leg by bolts, respectively.

A further improvement of the technical solution of the present invention is that: a bracket is disposed at a middle part of the square reinforcement frame, where a through-hole A is disposed in a middle part of the bracket, for reinforcing and supporting the sunshade.

The present invention has the following beneficial effects after adopting the above-mentioned technical solution:

1. According to an easy-to-transport assembled table provided by the present invention, the table top is split into a plurality of table plates, transported to the user's home, and then assembled. The table plate has a relatively small area, thus facilitating packaging and transportation, and reducing the transportation cost of the product.
2. According to an easy-to-transport assembled table provided by the present invention, the bottom surface of the table plate is provided with a storage cavity capable of storing parts such as a table leg, a bracket and a connecting plate, and since the parts such as the table leg, the bracket and the connecting plate are placed inside the table plate, both the space occupied by the table in the process of transportation and the transportation cost are reduced.
3. According to an easy-to-transport assembled table provided by the present invention, through-holes are disposed in the table top and a fixed frame for placing a sunshade pole, facilitating the user to place a sunshade for shading when using the table outdoors, and the two through-holes on the top and bottom further enhance the stability of the sunshade, which is extremely convenient to use.

BRIEF DESCRIPTION OF DRAWINGS

To describe the technical solutions in the specific embodiments of the present invention or in the prior art more clearly, the following briefly describes the accompanying drawings needed for describing the specific embodiments or the prior art. Apparently, the accompanying drawings in the following description show some embodiments of the present invention, and those of ordinary skill in the art may further derive other accompanying drawings from these accompanying drawings without creative labor.

Reference numbers in the accompanying drawings: 1—table plate; 2—through-hole A; 3—table top; 4—table leg; 5—frame; 6—table plate fixing hole; 7—bolt hole; 8—reinforcement frame fixing hole; 9—reinforcement frame; 10—through-hole; 11—square reinforcement frame; 12—bracket.

DETAILED DESCRIPTION OF THE EMBODIMENTS

An explicit and complete description of the technical solution in the present invention is given below in conjunction with the accompanying drawings. Apparently, the described embodiments are part of the embodiments of the present invention, not all of the embodiments. Based on the embodiments in the present invention, all other embodiments obtained by those of ordinary skill in the art without making creative labor fall within the scope of protection of the present invention.

In the description of the present invention, it should be noted that, the orientations or positional relationships indicated by the terms "center", "up", "down", "left", "right", "vertical", "horizontal", "inside", "outside", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention. Furthermore, the terms "first", "second", "third" are used for descriptive purposes only and not allowed to be construed as indication or implication of relative importance.

In the description of the present invention, it should be noted that, unless otherwise explicitly provided and limited, the terms "mounted", "attached", "connected" should be understood in a broad sense, e.g., it may be a fixed connection, a detachable connection or an integral connection; it may be a mechanical connection or an electrical connection; it may be a direct attachment, or an indirect attachment through an intermediate medium; and it may be a communication within two elements. For those of ordinary skill in the art, the specific meaning of the above-mentioned terms in the present invention can be construed according to specific cases.

The present invention is further explained and illustrated below in conjunction with specific embodiments.

Figure 1:
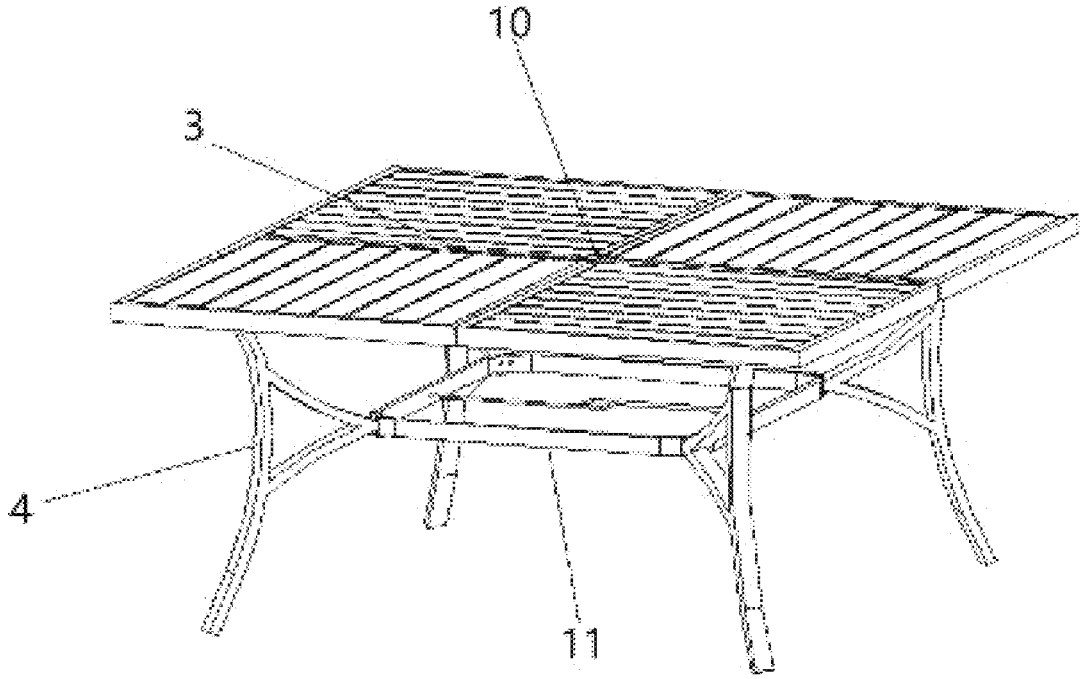
FIG. 1 is a schematic diagram of a three-dimensional structure of an easy-to-transport assembled table provided by the present invention.
Figure 2:
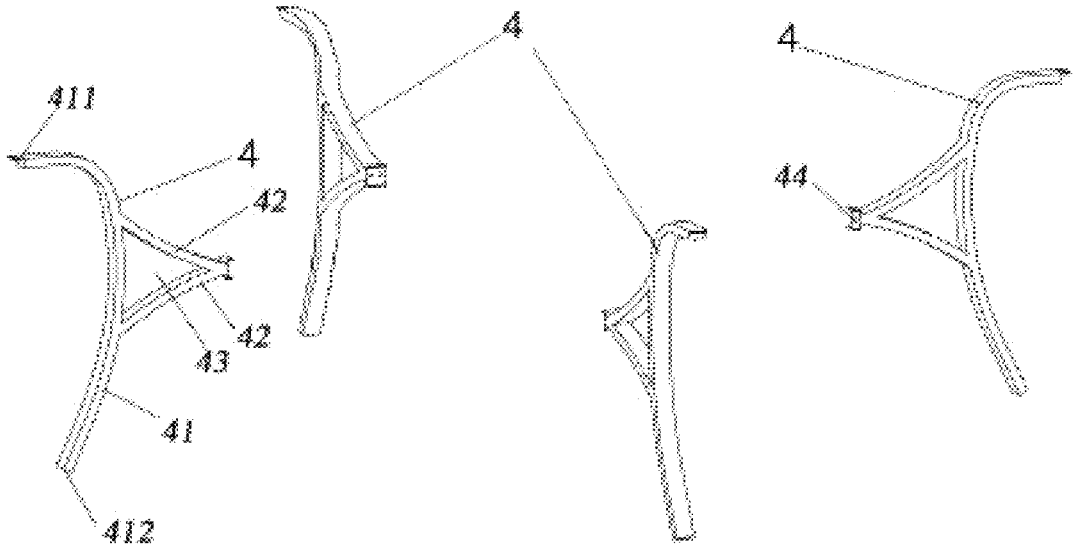
FIG. 2 is a schematic structural diagram of a table leg in FIG. 1.
Figure 3:
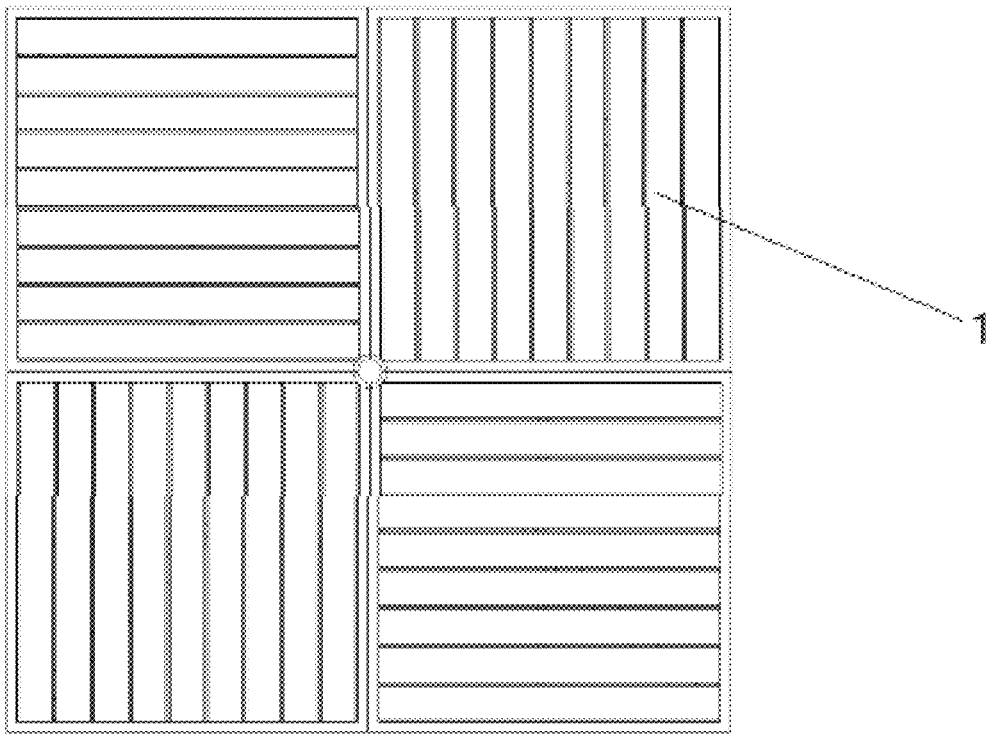
FIG. 3 is a top view of an assembled table top in FIG. 1.
Figure 4:
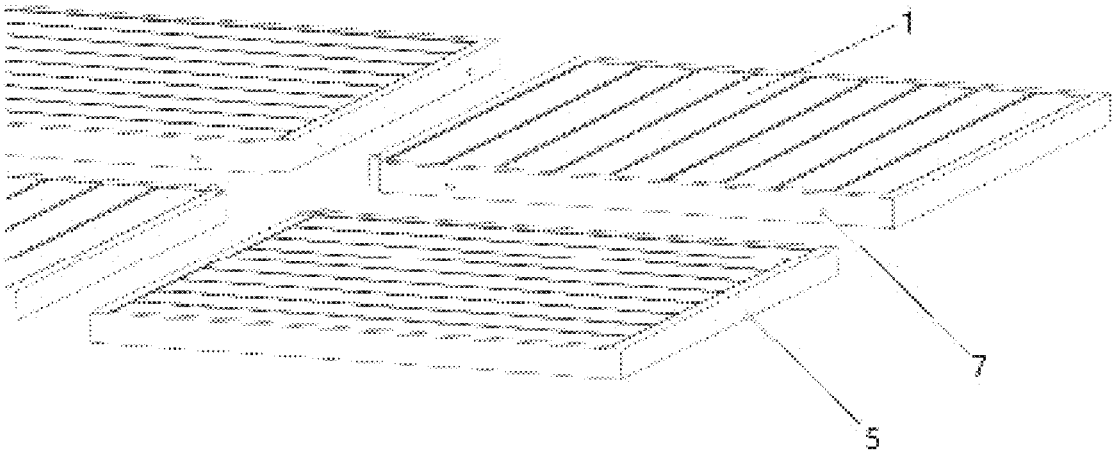
FIG. 4 is a schematic diagram of assembly of bolt holes of the table top in FIG. 1.
Figure 5:
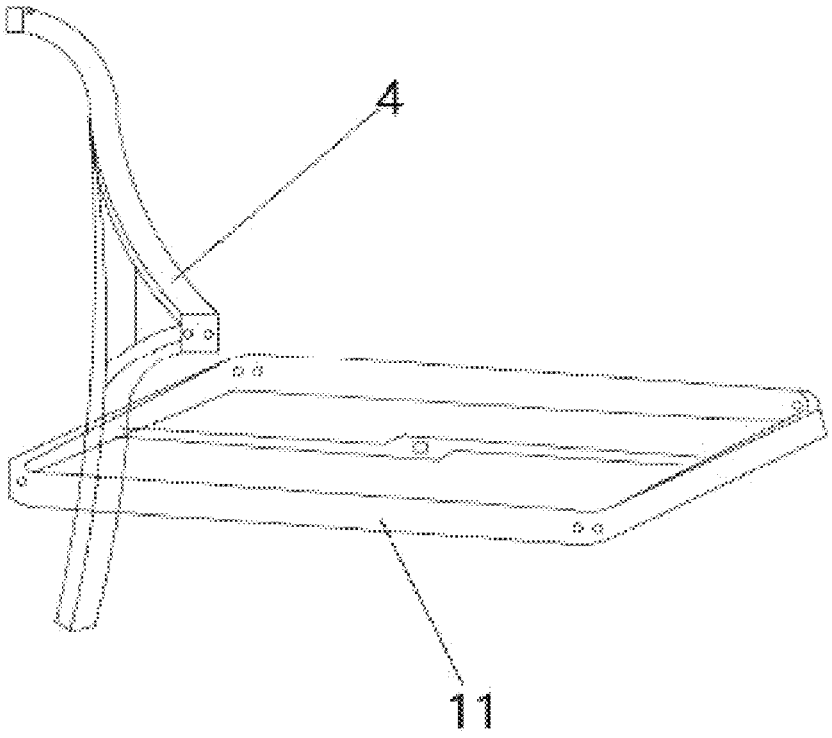
FIG. 5 is a schematic diagram of assembly of the table leg with a square reinforcement frame in FIG. 1.
Figure 6:
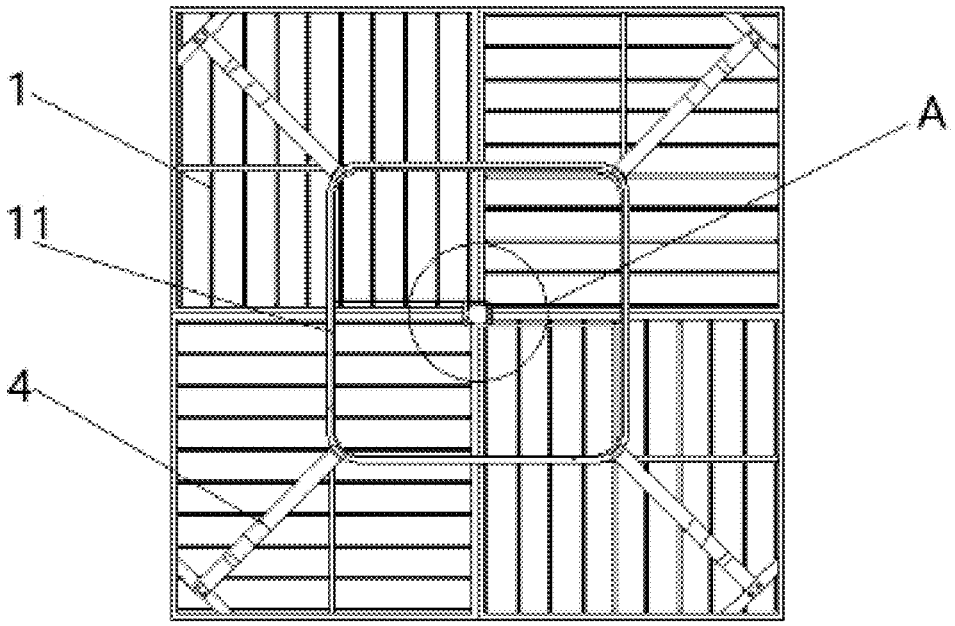
FIG. 6 is a bottom view of the assembled table in FIG. 1.
Figure 7:
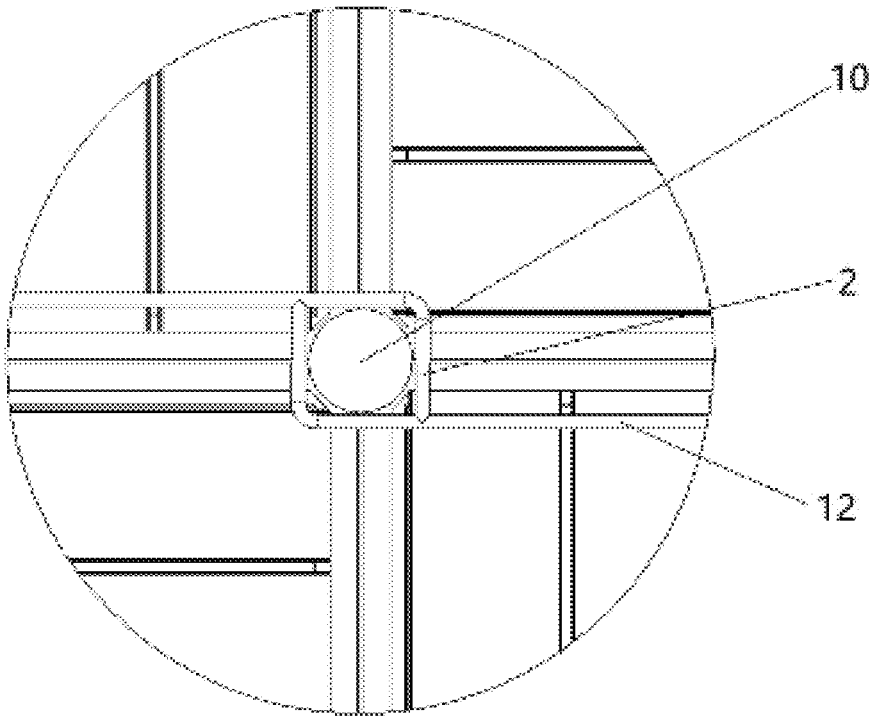
FIG. 7 is an enlarged view of part A in FIG. 6.
Figure 8:
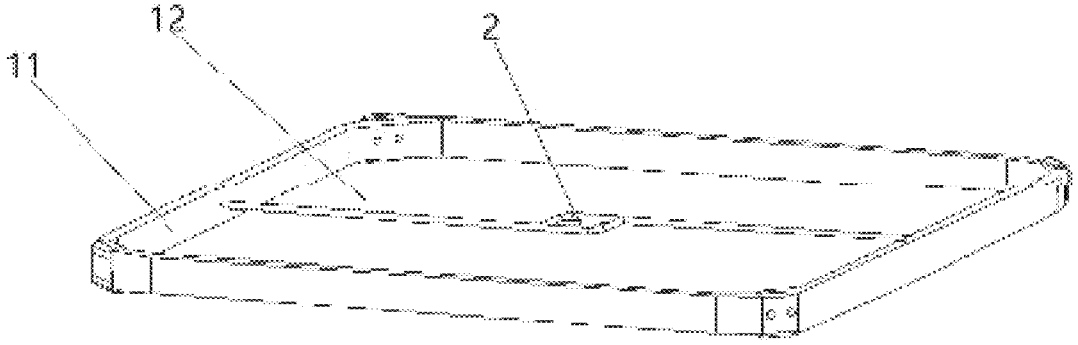
FIG. 8 is a schematic structural diagram of the square reinforcement frame in FIG. 1.
Figure 9:
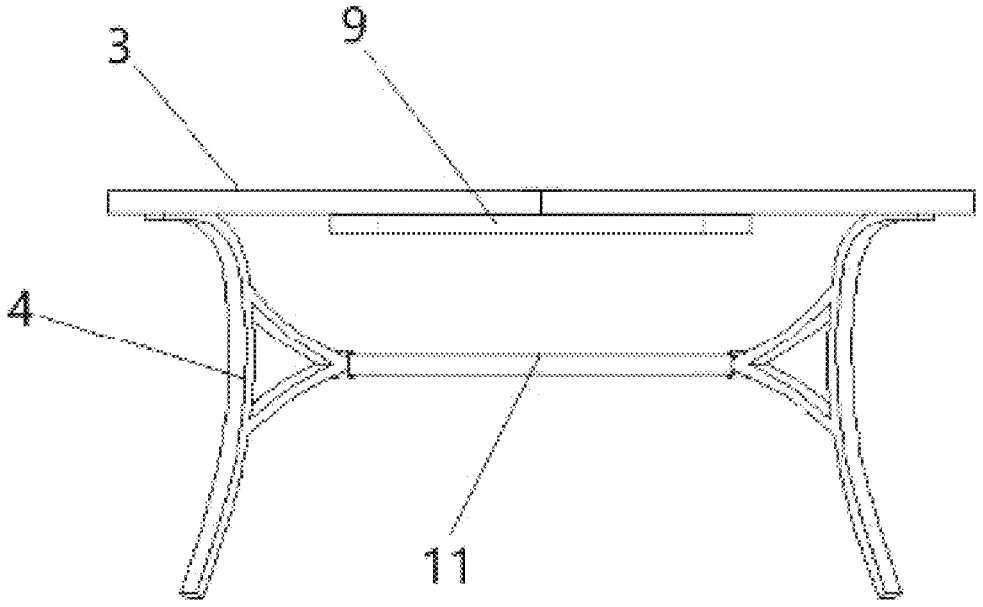
FIG. 9 is a schematic diagram of a side structure of FIG. 1.
Figure 10:
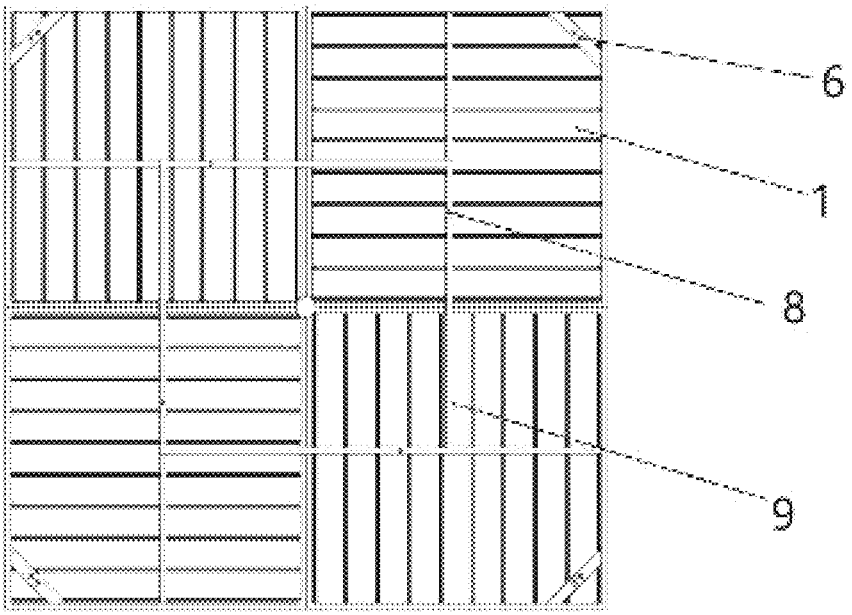
FIG. 10 is a bottom view of a reinforcement frame and a table plate in FIG. 1.
Figure 11:
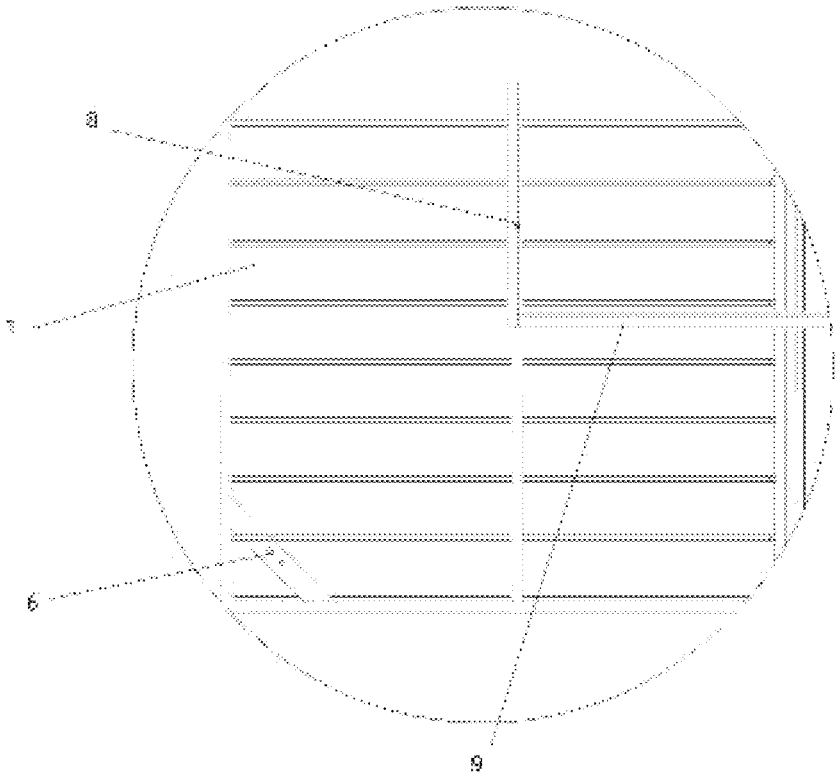
FIG. 11 is a partial enlarged view of FIG. 10.
Figure 12:
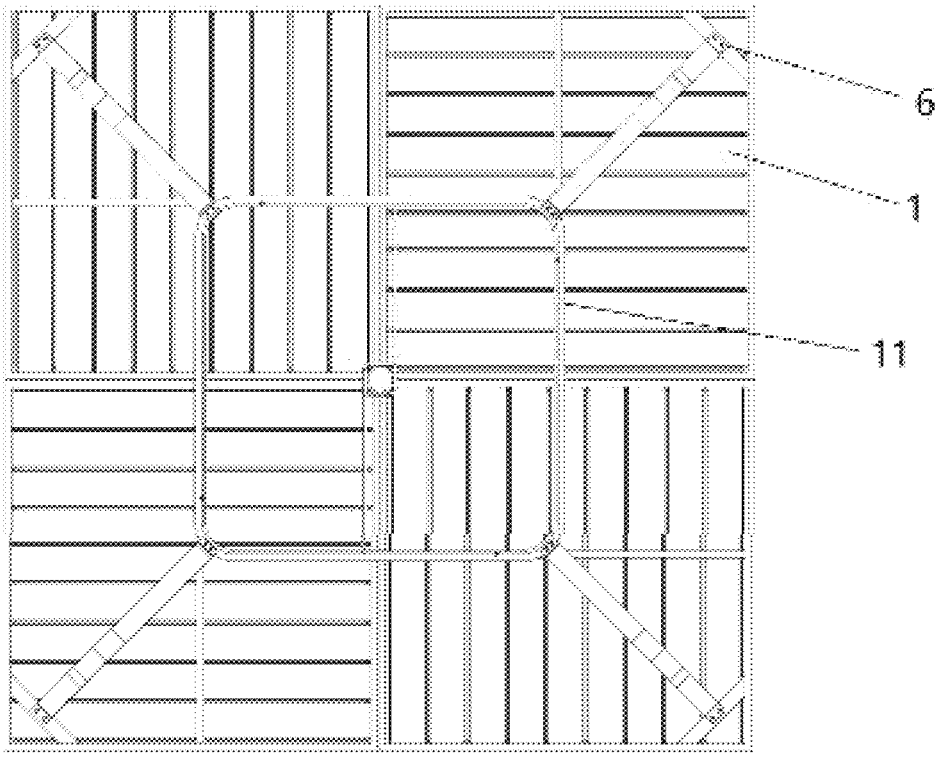
FIG. 12 is a bottom view of the square reinforcement frame in FIG. 1.

As shown in FIGS. 1-11, an easy-to-transport assembled table provided by the present embodiment includes table legs 4 disposed at each of four corners of a lower end surface of a table top 3, where the table top 3 consists of four table plates 1 of the same size assembled together, the table plates can be stacked for transportation, which is conducive to allocating the occupied space for transportation and reducing the cost of transportation; the table plate 1 includes a frame 5 and a table plate 1 welded on the inner side of the frame 5, the top surface of the frame 5 and the top surface of the table plate 1 are located in the same plane, the bottom surface of the frame 5 is lower than the bottom surface of the table plate 1, a plurality of bolt holes 7 are disposed in an assembling side edge of the frame 5, and the table plate 1 is assembled to form the table top 3 through the bolt holes 7 and the bolts. After being individually transported to a destination, the table plate 1 is assembled to form the integral table top 3 through the bolts, reducing the transportation cost of the table.

A reinforcement frame 9 is disposed at a middle part of the lower end surface of the table top 3, where the reinforcement frame 9 is fixed through a reinforcement frame fixing hole 8, enhancing the stability of the assembled table top 3; a connection member is welded and disposed to each of four corners of the bottom surface of the table top 3, a table plate fixing hole 6 is disposed at the bottom surface of the connection member, respectively, and the top part of the table leg 4 is fixed to the bottom surface of the connection member through the bolts and the fixing hole 6; the length of the table leg 4 is less than the width of the inner side of the frame 5, facilitating storage of the table leg 4 in the inner side of the frame 5, and reducing the space occupied by the table in the process of transportation; a through-hole 10 is disposed in a middle part of the table top 3 for installing and placing an outdoor sunshade, a square reinforcement frame 11 is disposed below the table top 3, the square reinforcement frame 11 is fixed to the middle part of the table leg 4 by bolts, respectively, a bracket 12 is disposed on the middle part of the square reinforcement frame 11, a through-hole A2 is disposed in the middle part of the bracket 12, and the design with two through-holes on the top and bottom makes the sunshade stand on the table top 3 more stably. Each table leg 4 comprises one main supporting leg 41 and two symmetrically configured supporting arms 42, the main supporting leg 41 is vertically arranged with a first end 411 in contact with the table top 3 and a second end 412 in contact with the ground when the table is in use, the two supporting arms 42 extend out from the main supporting leg 41 toward a plane where the square reinforcement frame 11 is located to converge with each other, thereby forming a triangular structure 43 with the main supporting leg 41, a joint of the two supporting arms 42 is provided with a connector 44, and the connector 44 is configured to connect the table leg 4 with the square reinforcement frame 11.

In the present embodiment, without changing the overall structure of the table plate 1 in the table top 3, the combination can be changed into a two-piece table and a six-piece table by adjusting the size of the table leg 4 and the reinforcement frame 9, or any and more combination of table top may be implemented according to the user's needs.

Finally, it should be noted that, the above-mentioned embodiments are only used to illustrate the technical solution of the present invention, not to act as a limitation; although the present invention is described in detail with reference to the foregoing embodiments, those of ordinary skill in the art should understand that it is still possible to modify the technical solution documented in the foregoing embodiments, or to make equivalent substitutions for part or all of the technical features therein; and these modifications or substitutions does not make the essence of the corresponding technical solution deviate from the scope of the technical solution described by embodiments of the present invention.

What is claimed is:

1. An easy-to-transport assembled table, comprising table legs disposed at each of four corners of a lower end surface of a table top and fixed by bolts, wherein the table top consists of two or more table plates, each of the table plates comprises a frame and the table plate is welded on an inner side of the frame, a top surface of the frame and a top surface of the table plate are located in the same plane, a bottom side surface of the frame is lower than a bottom surface of the table plate, a plurality of bolt holes are disposed in an assembling side edge of the frame of each table plate, and the table plates are assembled to form the table top through the bolt holes and bolts;

a reinforcement frame is disposed at a middle part of the lower end surface of the table top, the reinforcement frame is directly fixed to the table top through reinforcement frame fixing holes, enhancing stability of the assembled table top;

a square reinforcement frame is disposed below the reinforcement frame, and the square reinforcement frame is fixed to a middle part of each table leg by the bolts, respectively;

each of the table legs comprises one main supporting leg and two symmetrically configured supporting arms, the main supporting leg is vertically arranged with a first end in contact with the table top and a second end in contact with the ground when the table is in use, the two supporting arms extend out from the main supporting leg toward a plane where the square reinforcement frame is located to converge with each other, thereby forming a triangular structure with the main supporting leg, a joint of the two supporting arms is provided with a connector, and the connector is configured to connect the table leg with the square reinforcement frame.

2. The easy-to-transport assembled table according to claim 1, wherein a connection member is welded and disposed on each of four corners of a bottom surface of the table top, the connection members are provided with a table plate fixing hole, respectively, and top parts of the table legs are fixed to bottom surfaces of the connection members through the bolts and the table plate fixing holes.

3. The easy-to-transport assembled table according to claim 1, wherein a length of each table leg is less than a width of the inner side of the frame, facilitating storage of the table legs in the inner side of the frame.

4. The easy-to-transport assembled table according to claim 1, wherein a through-hole is disposed in a middle part of the table top for installing and placing an outdoor sunshade.

5. The easy-to-transport assembled table according to claim 1, wherein a bracket is disposed at a middle part of the square reinforcement frame, and a through-hole A is disposed in a middle part of the bracket for reinforcing and supporting the sunshade.

* * * * *